US005813578A

United States Patent [19]

Hsieh

[11] Patent Number: 5,813,578

[45] Date of Patent: Sep. 29, 1998

[54] FOLDABLE SUIT HANGER

[76] Inventor: Sing-Fuh Hsieh, P.O. Box 23-487, Changhua, Taiwan

[21] Appl. No.: 989,176

[22] Filed: Dec. 11, 1997

[30] Foreign Application Priority Data

Dec. 24, 1996 [TW] Taiwan ..... 85219993

[51] Int. Cl.[6] ..... A47G 25/40; A47G 25/14

[52] U.S. Cl. ..... 223/94; 223/89; 223/92; 223/85

[58] Field of Search ..... 223/85, 92, 89, 223/94

[56] References Cited

U.S. PATENT DOCUMENTS

| | | | |
|---|---|---|---|
| D. 157,089 | 1/1950 | Saunders | 223/94 |
| 2,540,508 | 2/1951 | Brown | 223/89 |
| 4,717,053 | 1/1988 | Wang | 223/94 |
| 5,085,357 | 2/1992 | Chen | 223/89 |
| 5,397,037 | 3/1995 | Ozawa | 223/94 |

*Primary Examiner*—Bibhu Mohanty

[57] ABSTRACT

A foldable suit hanger is composed of a hooked body, a retaining seat, two arms, and two side wings. The retaining seat is fastened at one end thereof with the hooked body, and at another end thereof with the arms. The arms are fastened pivotally and respectively with the side wings. The side wings are made up of two wing bodies which are connected by a plurality of connection rods such that the wing bodies are separated by a gap greater than the width of the arms. The wing bodies are provided respectively and correspondingly in the underside thereof with a recess. The hooked body, the retaining seat, the arms, and the side wings can be folded to join together such that the hooked body is received in the recesses of the wing bodies, and that the retaining seat and the arms are received in the gap of the side wing.

3 Claims, 5 Drawing Sheets

FOLDABLE SUIT HANGER

FIELD OF THE INVENTION

The present invention relates generally to a suit hanger, and more particularly to a foldable suit hanger.

BACKGROUND OF THE INVENTION

There are a variety of foldable suit hangers available in the market place today. These conventional foldable suit hangers are generally defective in design in that they are rather complicated in construction, and that they are therefore not cost-effective, and further that they are incapable of locating a heavy suit or coat, and still further that they are not enticing to the consumers at large. In addition to the shortcomings described above, they can not be used for other purposes when they are in a folded state.

SUMMARY OF THE INVENTION

It is therefore the primary objective of the present invention to provide a foldable suit hanger, which can be made economically.

It is another objective of the present invention to provide a foldable suit hanger, which is easy to use.

It is still another objective of the present invention to provide a foldable suit hanger with a brush for cleaning or polishing the suit.

It is still another objective of the present invention to provide a foldable suit hanger capable of locating a heavy suit.

It is still another objective of the present invention to provide a foldable suit hanger enticing to the consumers.

In keeping with the principle of the present invention, the foregoing objectives of the present invention will be more readily understood upon a thoughtful deliberation of the following detailed description of the embodiments of the present invention with reference to the accompanying drawings.

BRIEF DESCRIPTION OF THE DRAWINGS

FIG. 7 shows a schematic view of the present invention being used as a brush.

DETAILED DESCRIPTION OF THE EMBODIMENTS

Figure 1:
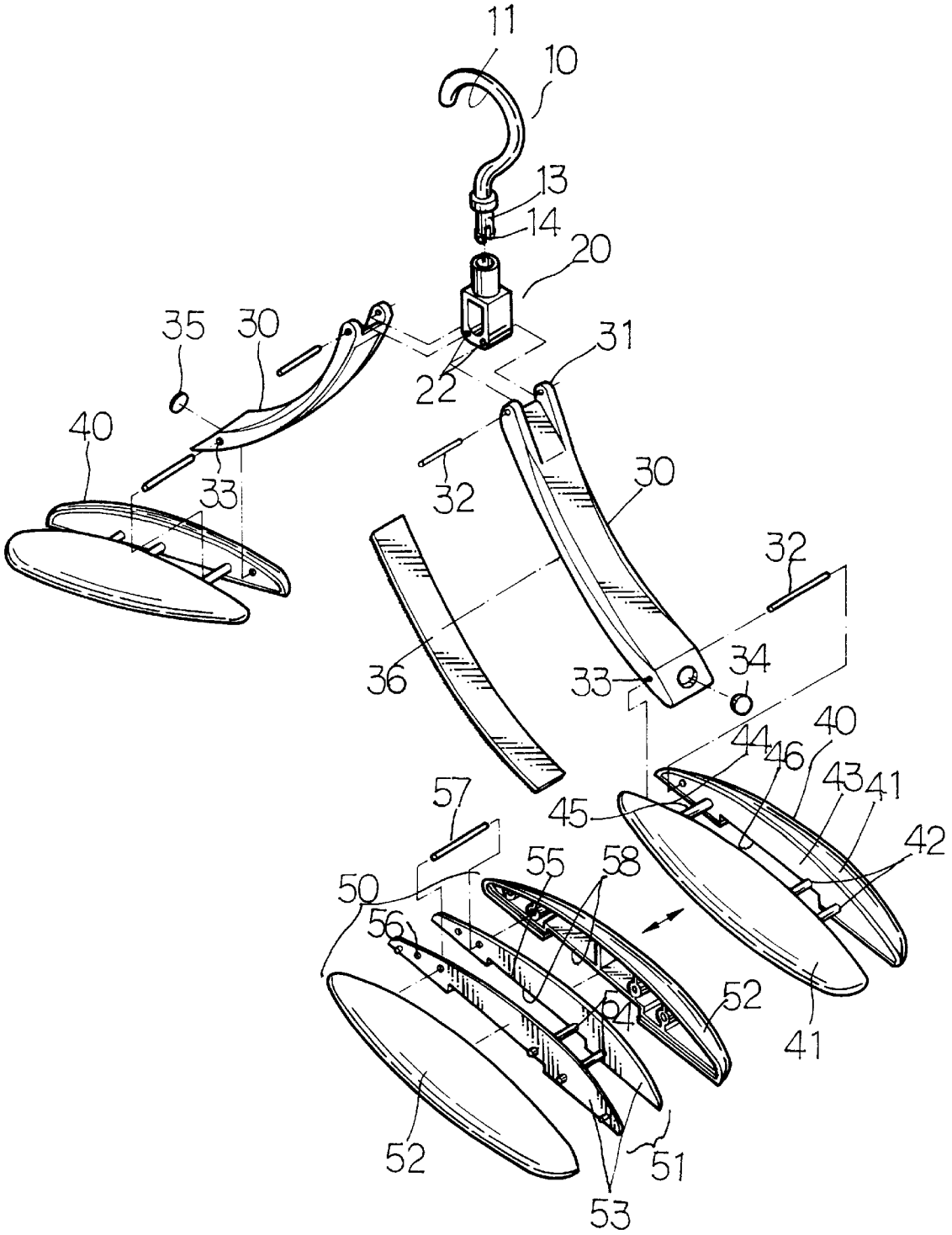
FIG. 1 shows an exploded view of the embodiment of the present invention.
Figure 2:
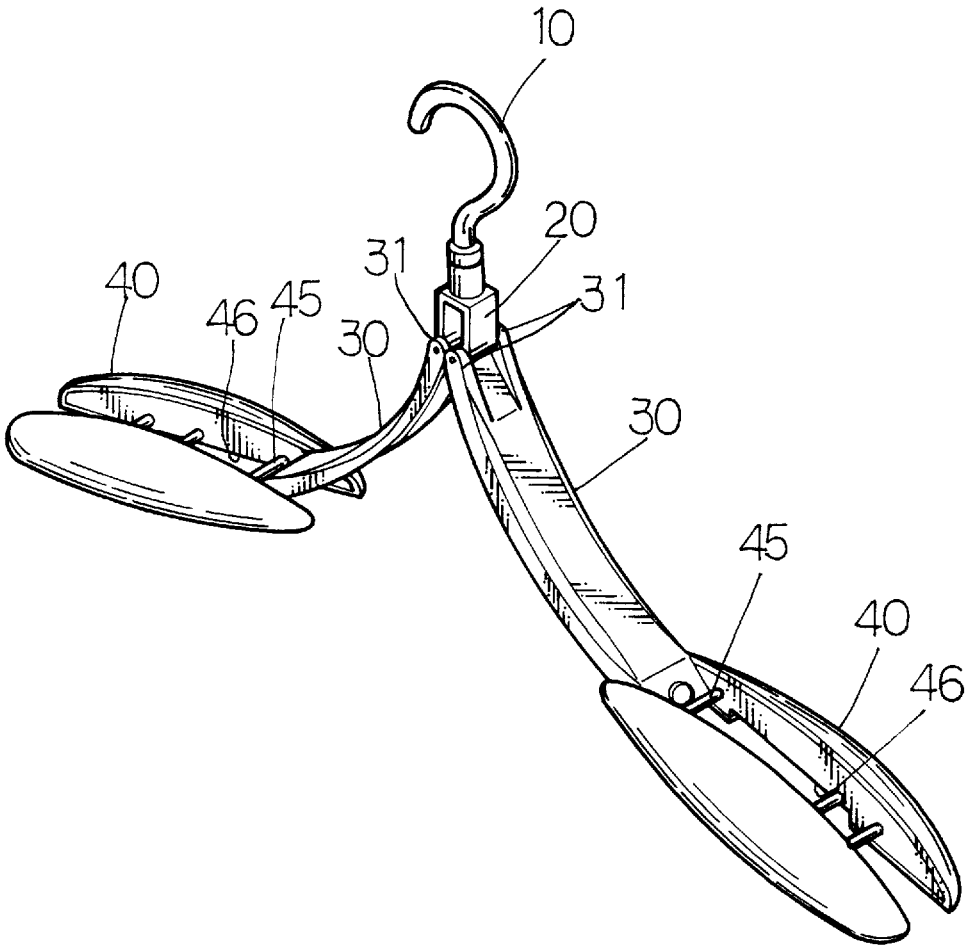
FIG. 2 shows a perspective view of the embodiment of the present invention in combination.

As shown in FIGS. 1 and 2, a foldable suit hanger embodied in the present invention is composed of a hooked body 10, a retaining seat 20, two arms 30, and two side wings 40.

The hooked body 10 comprises a hook 11 and a connection portion 13 having a protruded portion 12 which is provided with a slot 14.

The retaining seat 20 comprises a connection hole 21 and two through holes 22 perpendicular to the connection hole 21. The hooded body 10 is retained by the retaining seat 20 such that the connection portion 13 is engaged with the connection hole 21.

Two arms 30 are provided respectively at one end thereof with two lugs 31 each having a through hole for use in fastening one end of the arms 30 with the retaining seat 20 by means of a pin 32 which is engaged with the through holes of the lugs 31 of the arms 30 and the through holes 22 of the retaining seat 20. The arms 30 are further provided respectively at another end thereof with a through hole 33, and two retaining pieces 34 and 35, which may be a magnet or iron block. One of the two arms 30 is provided with a brush 36 attached thereto.

Two side wings 40 are identical in construction to each other. For this reason, only one side wing 40 will be explicitly described here. The side wing 40 is composed of two wing bodies 41 symmetrical with each other, and a plurality of connection bars 42 holding the wing bodies 41 such that the wing bodies 41 are separated by a gap 43 slightly greater than the width of the arms 30. The two wing bodies 41 are provided respectively and correspondingly at one end thereof with a through hole which is engaged with a pivot 32 for fastening pivotally the wing bodies 41 with the arms 30. A locating rod 45 is provided between the wing bodies 41. The wing bodies 41 are similar in curvature to the arms 30 and are provided respectively and correspondingly in the underside thereof with a recess 46.

As illustrated in FIG. 2, the foldable suit hanger of the present invention can be easily unfolded by moving two side wings 40 in the direction away from the arms 30. The arms 30 and the side wings 40 are located by the locating rods 45 when the suit hanger of the present invention remains in the unfolded state.

Figure 3:
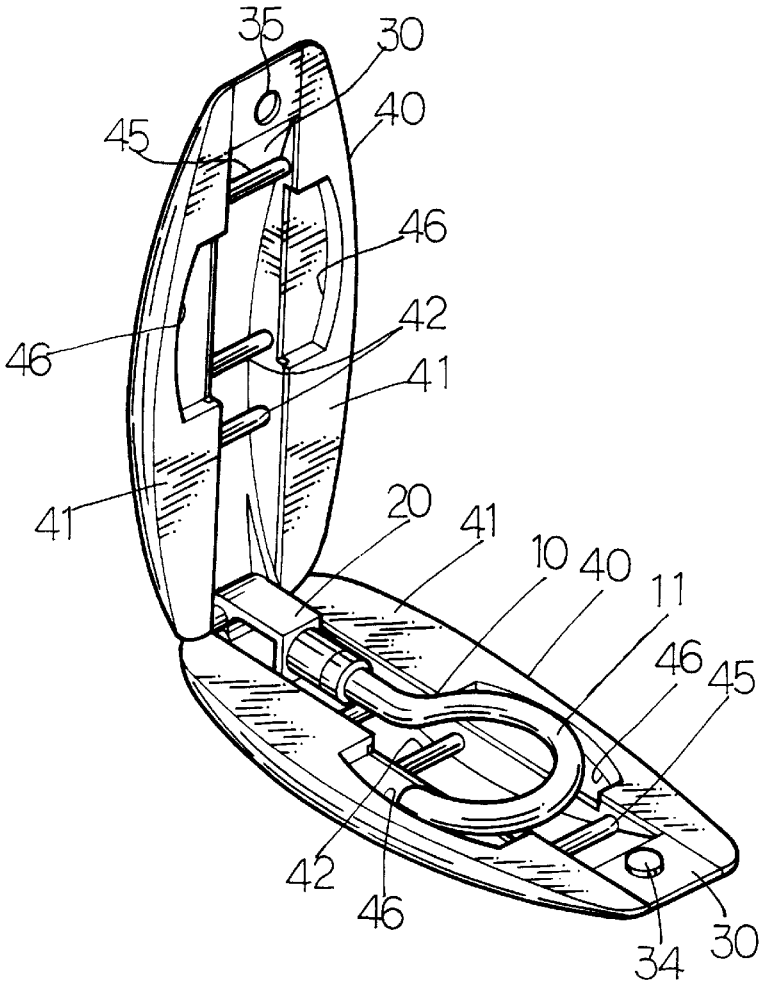
FIG. 3 shows a partial schematic view of the embodiment of the present invention.
Figure 4:
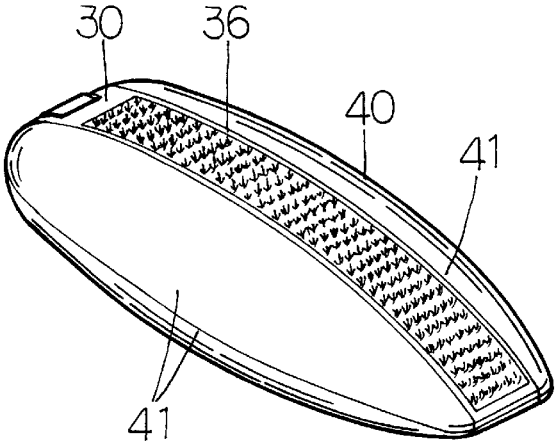
FIG. 4 shows another partial schematic view of the present invention.
Figure 5:
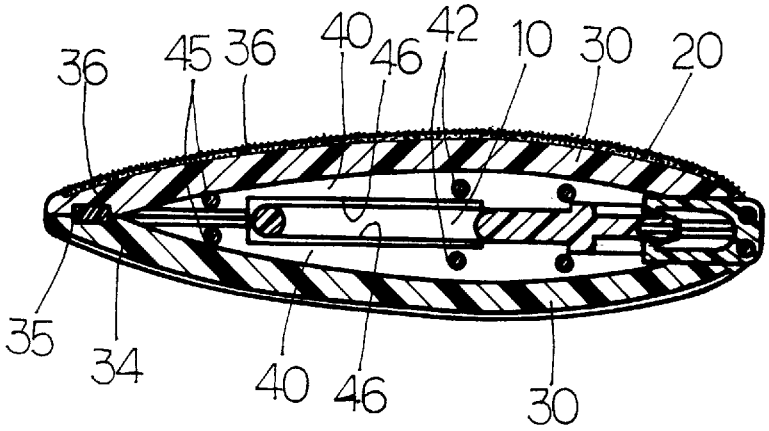
FIG. 5 shows a perspective view of the present invention in a folded state.
Figure 6:
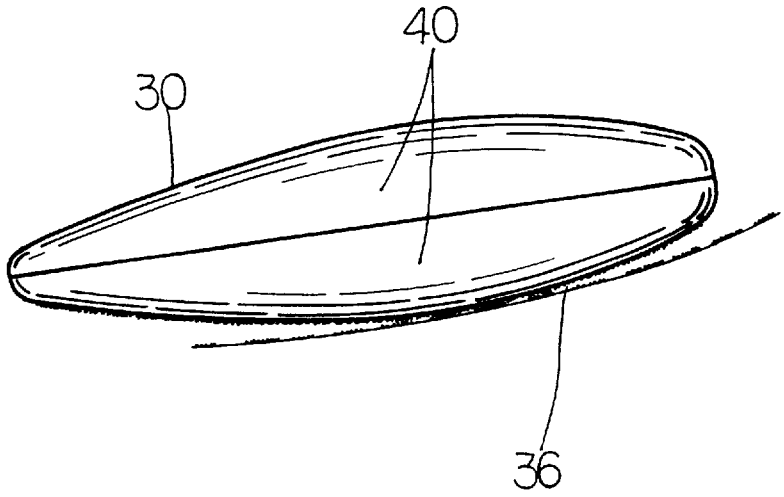
FIG. 6 shows a longitudinal sectional view of the present invention as shows in FIG. 5.

As illustrated in FIG. 3, the foldable suit hanger of the present invention is folded by enclosing the arms 30 with the side wings 40 such that the arms 30, the retaining seat 20 and the hooked body 10 are located in the gap 43 of the side wing 40, and further that the hook 11 of the hooked body 10 is located in the recesses 46 of the wing bodies 41 of the side wing 40. The arms 30 are further located by means of the retaining pieces 34 and 35. As a result, the suit hanger of the present invention can be folded to remain compact, as shown in FIGS. 4 and 5, for easy storage and transportation. In addition, the suit hanger of the present invention can be used as a brush in view of the brush 36 which is attached to one of the two arms 30, as illustrated in FIGS. 1 and 4.

The embodiment of the present invention described above is to be regarded in all respects as being merely illustrative and not restrictive. Accordingly, the present invention may be embodied in other specific forms without deviating from the spirit thereof. For example, the present invention may comprise two side wings 50, which are composed of a frame 51 and two wing bodies 52. The frame 51 is sandwiched between the two wing bodies 52 and is made up of two parallel wing pieces 53 and a plurality of connection rods 54 connecting the wing pieces 53 such that there is a gap 55 between the two wing pieces 53. The gap 55 is slightly greater than the width of the arms 30. The wing pieces 53 of the frame 51 are provided respectively and correspondingly at one end thereof with a through hole 56 which is engageable with the pivot 32. The wing bodies 52 and the wing pieces 53 are provided respectively and correspondingly at one end thereof with a locating hole engageable with a locating rod 57. In addition, the wing bodies 52 and the wing pieces 53 are provided respectively and correspondingly in the underside thereof with a recess 58. The present invention is therefore to be limited only by the scopes of the following appended claims.

What is claimed is:

1. A foldable suit hanger comprising:

a hooked body;

a retaining seat fastened at one end thereof with said hooked body and provided at another end thereof with two through holes;

two arms engaged respectively at one end thereof with said another end of said retaining seat; and two side wings fastened pivotally and respectively at one end thereof with another end of said two arms;

wherein said two arms have a curvature and provided respectively at one end thereof with two lugs each having a through hole for fastening said arms with said retaining seat in conjunction with said through holes of said retaining seat and a pin, said arms further provided respectively at another end thereof with a through hole engageable with a pivot;

wherein said two side wings are composed of two wing bodies symmetrical to each other and similar in curvature to said arms, said side wings further composed of a locating rod and a plurality of connection rods holding said two wing bodies such that said two wing bodies are separated by a gap greater than a width of said arms, said two wing bodies provided respectively and correspondingly at one end thereof with a through hole for fastening pivotally said side wings with said arms in conjunction with said through holes of said another ends of said arms and said pivots, said wing bodies further provided respectively in an underside thereof with a recess;

wherein said hooked body, said retaining seat, said arms, and said side wings can be folded to join together such that said retaining seat and said arm are located in said gap of said side wing, and that said hooked body is received in said recesses of said wing bodies of said side wing.

2. The foldable suit hanger as defined in claim 1, wherein one of said two arms is provided in an underside thereof with a brush attached thereto.

3. The foldable suit hanger as defined in claim 1, wherein said side wings are composed of a frame and two wing bodies, said frame being sandwiched between said two wing bodies and formed of two parallel wing pieces and a plurality of connection rods connecting said wing pieces such that said wing pieces are separated by a gap greater than said width of said arms, said wing pieces of said frame provided respectively and correspondingly at one end thereof with a through hole engageable with said pivot, said wing bodies and said wing pieces provided respectively and correspondingly at one end thereof with a locating hole engageable with a locating rod, and in an underside thereof with a recess.

* * * * *